US009160112B2

(12) United States Patent
Rutherford et al.

(10) Patent No.: US 9,160,112 B2
(45) Date of Patent: Oct. 13, 2015

(54) ARRANGEMENT FOR PROTECTING AGAINST INCORRECT PLUGGING OF PLUG-IN MODULES

(71) Applicant: Schroff GmbH, Straubenhardt (DE)

(72) Inventors: Paul Rutherford, Karlsruhe (DE); Christian Ganninger, Pforzheim (DE); Sergej Dizel, Karlsruhe (DE)

(73) Assignee: Pentair Technical Solutions GmbH, Straubenhardt (DE)

( * ) Notice: Subject to any disclaimer, the term of this patent is extended or adjusted under 35 U.S.C. 154(b) by 0 days.

(21) Appl. No.: 14/063,203

(22) Filed: Oct. 25, 2013

(65) Prior Publication Data

US 2014/0127934 A1 May 8, 2014

(30) Foreign Application Priority Data

Nov. 6, 2012 (EP) ..... 12191438

(51) Int. Cl.

*H01R 13/64* (2006.01)
*H01R 12/70* (2011.01)
*H01R 13/645* (2006.01)

(52) U.S. Cl.

CPC ..... *H01R 13/64* (2013.01); *H01R 12/7047* (2013.01); *H01R 12/7052* (2013.01); *H01R 13/6453* (2013.01)

(58) Field of Classification Search

CPC .. H01R 13/631; H01R 23/7005; H01R 13/64; H01R 13/6456; H05K 7/1418
USPC ..... 439/374, 377, 37, 677, 678, 680, 681; 361/756, 786
See application file for complete search history.

(56) References Cited

U.S. PATENT DOCUMENTS

| | | | | | |
|---|---|---|---|---|---|
| 3,582,867 | A * | 6/1971 | Thompson et al. | ..... | 439/362 |
| 4,568,134 | A * | 2/1986 | DiMondi | ..... | 439/64 |
| 4,776,811 | A * | 10/1988 | Humphrey | ..... | 439/378 |
| 4,925,400 | A * | 5/1990 | Blair et al. | ..... | 439/374 |
| 4,929,184 | A * | 5/1990 | Emadi et al. | ..... | 439/681 |
| 4,934,950 | A * | 6/1990 | Green et al. | ..... | 439/681 |
| 5,535,100 | A * | 7/1996 | Lubahn et al. | ..... | 361/801 |
| 6,358,075 | B1 * | 3/2002 | Tischner | ..... | 439/248 |

(Continued)

FOREIGN PATENT DOCUMENTS

EP 1 753 281 B1 10/2009

*Primary Examiner* — Thanh Tam Le
(74) *Attorney, Agent, or Firm* — Bose McKinney & Evans LLP

(57) ABSTRACT

An arrangement for protecting against incorrect plugging of plug-in modules on the front side and rear side of a backplane comprises pairs of guide pin elements with guide pins pointing in opposite directions that extent along a common longitudinal axis perpendicular to the backplane. The guide pin elements engage positively in corresponding guide receptacles of the plug-in modules when they are plugged on in the correct orientation relative to the guide pins. The arrangement comprises means for non-rotatably mounting the guide pin elements on the front side and rear side of the backplane in a predetermined angular position. The two guide pin elements are identical. Arranged between the guide pin elements is a central connecting member that can be inserted in a non-rotatable manner into an attachment hole of the backplane. The connecting member has two molded sections that point in opposite directions and engage positively in commensurately embodied recesses, thus establishing the angular position of the guide pins relative to the backplane.

11 Claims, 4 Drawing Sheets

(56) References Cited

U.S. PATENT DOCUMENTS

| | | | | |
|---|---|---|---|---|
| 6,945,810 | B1 * | 9/2005 | Morana et al. | 439/378 |
| 7,326,092 | B2 * | 2/2008 | Fedder et al. | 439/681 |
| 7,621,754 | B2 * | 11/2009 | Costello | 439/65 |
| 7,907,419 | B2 * | 3/2011 | Costello | 361/786 |
| 8,231,399 | B2 * | 7/2012 | Daubigney | 439/316 |
| 2007/0037434 | A1 | 2/2007 | Fedder et al. | |
| 2011/0256753 | A1 | 10/2011 | Gulla | |

* cited by examiner

ARRANGEMENT FOR PROTECTING AGAINST INCORRECT PLUGGING OF PLUG-IN MODULES

RELATED APPLICATIONS

This application claims priority to EP 12 191 438.6, filed Nov. 6, 2012, which is hereby incorporated herein by reference in its entirety.

BACKGROUND

The invention relates to an arrangement for protecting against the incorrect plugging of plug-in modules on the front and rear side of a backplane, comprising at least one pair of guide pin elements with guide pins pointing in opposite directions which extend along a common longitudinal axis perpendicularly to the backplane and engage positively in corresponding guide receptacles of the plug-in modules when they are plugged on the correct way around, and means for non-rotatably mounting the guide pin elements on the front and rear side of the backplane in a predetermined angular position.

Such arrangements are used, among other things, in 19" rack mount systems and in AIR Transition Racks (ATR) and ensure, for example, that electrical plug-in assemblies can only be plugged in the correct position onto slots on the backplane.

U.S. Pat. No. 6,945,810 B1 describes an arrangement with guide pins that are embodied as one-piece elements. Between the two ends, the guide pins have a mounting area that is bounded on one side by an offset. The attachment area enables the non-rotatable attachment of the guide pin on the backplane. For this purpose, the guide pin is plugged in a positive manner into a through hole in the backplane. While the offset lies against one side of the backplane, a nut is screwed onto the guide pin on the opposite side of the backplane in order to attach the guide pin to the backplane. Both ends of the guide pin have coding surfaces that engage into corresponding receptacles on the plug-in modules or plug-in assemblies. The position of the coding surfaces relative to each other cannot be changed, which represents a limitation.

EP 1 753 281 B1 describes a multipart guide pin comprising a first and a second guide pin element which are plugged into a through hole in a backplane from mutually opposing sides. The first guide pin element has a through hole through which an attachment element engages into a threaded hole in the second guide pin element, thus fixing the two guide pin elements to the backplane. At the opposing ends, the guide pin elements each have a rib that engages into a radial recess in the hole of the backplane. Both ribs can engage either in a common radial recess or in two separate recesses. Each of the two guide pin elements has a coding surface that engages into corresponding receptacles of the plug-in modules when they are plugged onto the guide pin elements. If the ribs engage into a single recess in the hole of the backplane, the coding surfaces are aligned parallel in relation to each other. If the ribs are arranged in radially different recesses, the coding surfaces are rotated in relation to each other. The manufacture of such a guide pin arrangement, particularly of the guide pin elements, is elaborate, and assembly is laborious.

SUMMARY

The present invention provides an arrangement for protecting against incorrect plugging of plug-in modules with two coaxial guide pins that is especially inexpensive to manufacture and easy to mount.

In the arrangement according to this disclosure, the two guide pin elements are identical. The manufacturing process is simplified in this way, and the required manufacturing time is shortened. Mounting is simplified because the parts cannot be confused.

Arranged between the guide pin elements is a central connecting member that can be inserted into an attachment hole of the backplane. Preferably, the connecting member engages positively in the attachment hole.

The connecting member has two molded sections that point in opposing directions and engage positively in commensurately embodied recesses of the guide pin elements, thus establishing the angular position of the guide pins about the longitudinal axis relative to the backplane. When the molded sections engage in the recesses of the guide pin elements, a rotation of the guide pin elements relative to the connecting member is no longer possible. The angular positions of the guide pins relative to the backplane are determined by the structure of the molded sections. For example, the molded sections can each have molded surfaces that are arranged at different angles about the longitudinal axis relative to the backplane. This results in different angular positions of the guide pins about the longitudinal axis relative to the backplane. However, it is also possible to arrange the molded surfaces parallel to each other so that the guide pin elements necessarily have identical angular positions relative to the backplane.

Preferably, the connecting member is cylindrical and arranged coaxially to the longitudinal axis of the guide pin elements. For example, the recesses in the guide pin elements are embodied in the direction of the longitudinal axis. The guide pin elements can therefore be plugged onto the connecting member along the longitudinal axis.

It is expedient for the connecting member to have a radially outward-pointing lug. The connecting member is preferably arranged in an attachment hole in the backplane, the lug engaging into a radial recess on this attachment hole. This ensures the non-rotatable arrangement of the connecting member on the backplane.

Another optional feature of this disclosure is that the guide pin elements have central through holes and the connecting member has threaded holes aligned with same, and threaded rods are provided which engage through the through holes into the threaded holes. Mounting is then performed by plugging the guide pin elements along the longitudinal axis into the connecting member so that the molded sections of the connecting member engage in recesses of the guide pin elements. One threaded rod is plugged into the respective through hole of a guide pin element and then screwed into the threaded hole of the connecting member. A non-rotatable connection is thus established between the guide pin elements and connecting member.

The guide pins advantageously have lateral coding surfaces in order to ensure a predefined orientation of the plug-in modules relative to the guide pins. For example, receptacles are arranged on the plug-in modules that are embodied so as to correspond with the guide pins with their coding surfaces. The modules can therefore only be pushed in a predefined position onto the guide pins. For example, if several guide pin elements are arranged in pairs on a backplane on the same side, and if the plug-in modules have commensurately arranged receptacles, then incorrect plugging of the plug-in modules into slots on the backplane is reliably prevented.

In one exemplary embodiment, the guide pin elements are arranged in identical angular positions in the direction of rotation about the longitudinal axis, so that the coding surfaces are oriented parallel to each other. The standard ANSI/

VITA 46.0 for VPX bus boards requires a coding system in which two plug-in modules that are plugged in from two opposing sides into the slots on the backplane are coded equally. This means that the coding surfaces on the guide pins must always be parallel to each other and positioned at the same angle with respect to the backplane. By arranging the guide pin elements in identical angular positions in the direction of rotation about the longitudinal axis, the standard ANSI/VITA 46.0 is complied with.

In an advantageous modification of the arrangement according to the invention, a spacer with an L-shaped cross section is provided whose first L-shaped arm extends parallel to a guide pin and whose second L-shaped arm has a recess into which the guide pin element engages. If an erroneous attempt is made to place an assembly module in laterally transposed fashion onto the guide pin elements, it abuts the free end of the vertical L-shaped arm before it reaches a slot on the backplane. As a result, damage to the plug contacts on the assembly modules and of the assembly modules themselves caused mechanically and by short circuits is prevented. The backplane is therefore also protected from damage.

Preferably, the L-shaped spacer towers directly next to the associated guide pin element. This results in a space-saving arrangement. Additional attachment holes such as those that are suggested, for example, by the standard ANSI/VITA 46.0 for the attachment of spacers and that entail an additional weakening of the backplane are avoided.

Especially advantageously, the guide pin element engages positively into the recess of the associated spacer, so that the spacer is arranged non-rotatably relative to the guide pin element. In this way, the spacers are not able to rotate relative to the guide pin elements, and lasting protection of the contacts on the assembly modules is ensured. For example, the recess of the spacer is embodied as an internal octagon that is plugged onto an external octagon on the guide pin element. However, other contours of spacer and guide pin element are also conceivable.

In an advantageous modification, the arrangement has a number of guide pin elements that are arranged with spacing from each other on the same side of the backplane, and a number of spacers, with at least two spacers being connected by a reinforcement rail that extends perpendicular to the plane of the backplane. Since at least two spacers are connected together by a reinforcement rail, the backplane is provided with additional rigidity against bending. This is particularly advantageous for compensating for the high levels of plugging force that occur when the plug-in modules are plugged into the slots arranged on the backplane.

An especially high level of rigidity is achieved if the spacers and/or the reinforcement rail are made of metal and in a single piece. However, other materials with high rigidity are also conceivable.

Another advantageous embodiment of the arrangement is characterized by a mounting bracket that is arranged between two spacers spaced apart from each other and connects a guide pin element to the reinforcement rail. The backplane can be made rigid over greater lengths by means of an additional mounting bracket. This is advantageous, for example, if plug-in modules have two plug connectors spaced apart from each other and, between them, a receptacle for a guide pin element. The plugging forces in such plug-in modules with several plug connectors are incomparably greater than in plug-in modules with only one plug connector, which is why additional rigidity is required.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
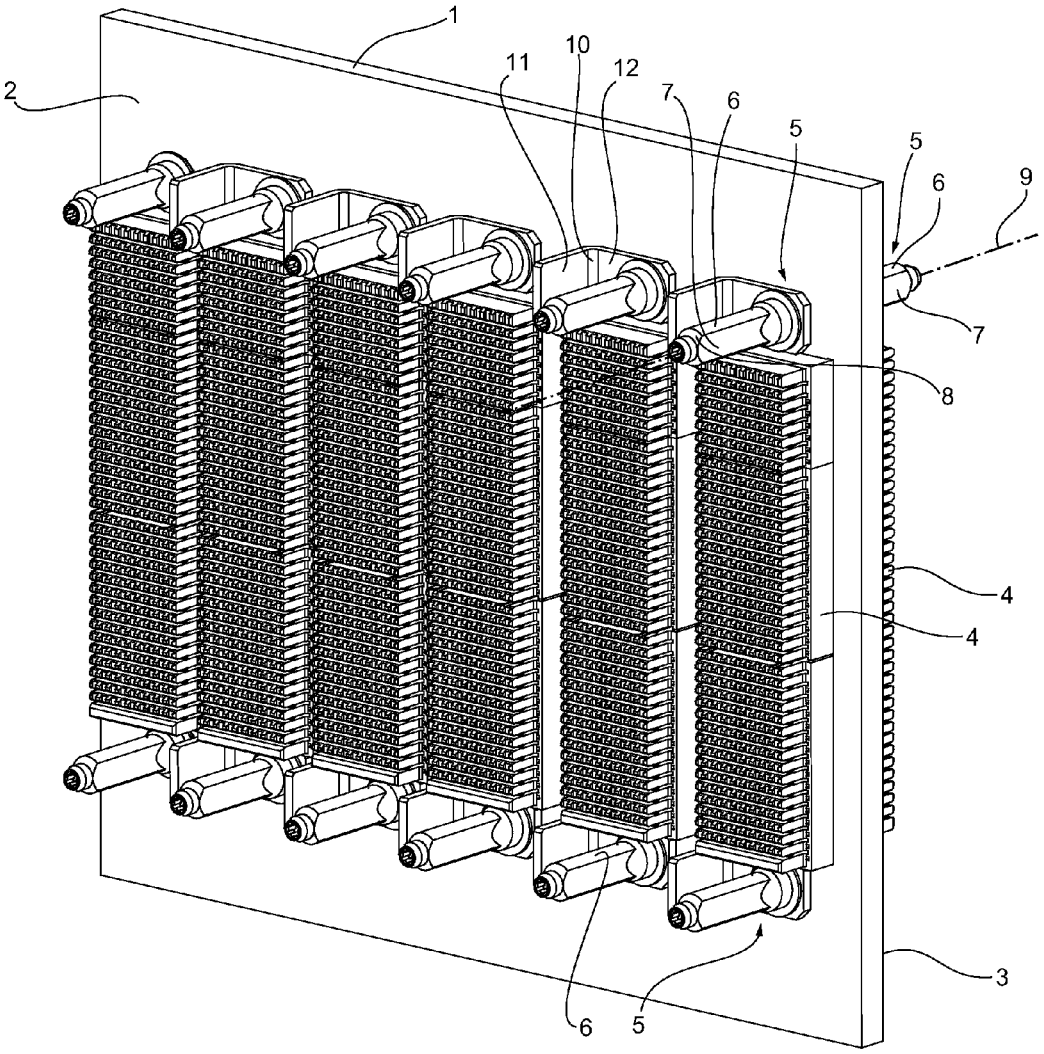
FIG. 1 shows a perspective view of a first backplane with several slots and a corresponding number of guide pin elements.

FIG. 1 shows a backplane 1 on whose front side 2 and rear side 3 several slots 4 are respectively arranged for electronic plug assemblies or plug-in modules. Above and below each slot 4 is located a respective guide pin element 5 with a guide pin 6. The guide pins 6 have lateral coding surfaces 7 and a tapered end 8.

On the rear side 4 of the backplane 1, another identical guide pin element 5 is associated to each guide pin element 5 located on the front side 2 of the backplane 1. Both guide pin elements 5 are attached together to the backplane 1. The guide pins 6 of the associated pair of guide pin elements 5 point in opposite directions and extend coaxially along a common longitudinal axis 9 that runs perpendicular to the backplane 1. The guide pins arranged coaxially in pairs prevent incorrect plugging of the plug-in modules (not shown).

Optionally, a spacer 10 with an L-shaped cross section can be respectively attached to one or more guide pin elements 5. The spacer 10 has a first L-shaped arm 11 that extends parallel to the guide pins 6. A second arm 12 of the spacer 10 runs transversely to the longitudinal axis 9 and lies against the backplane 1.

Figure 2:
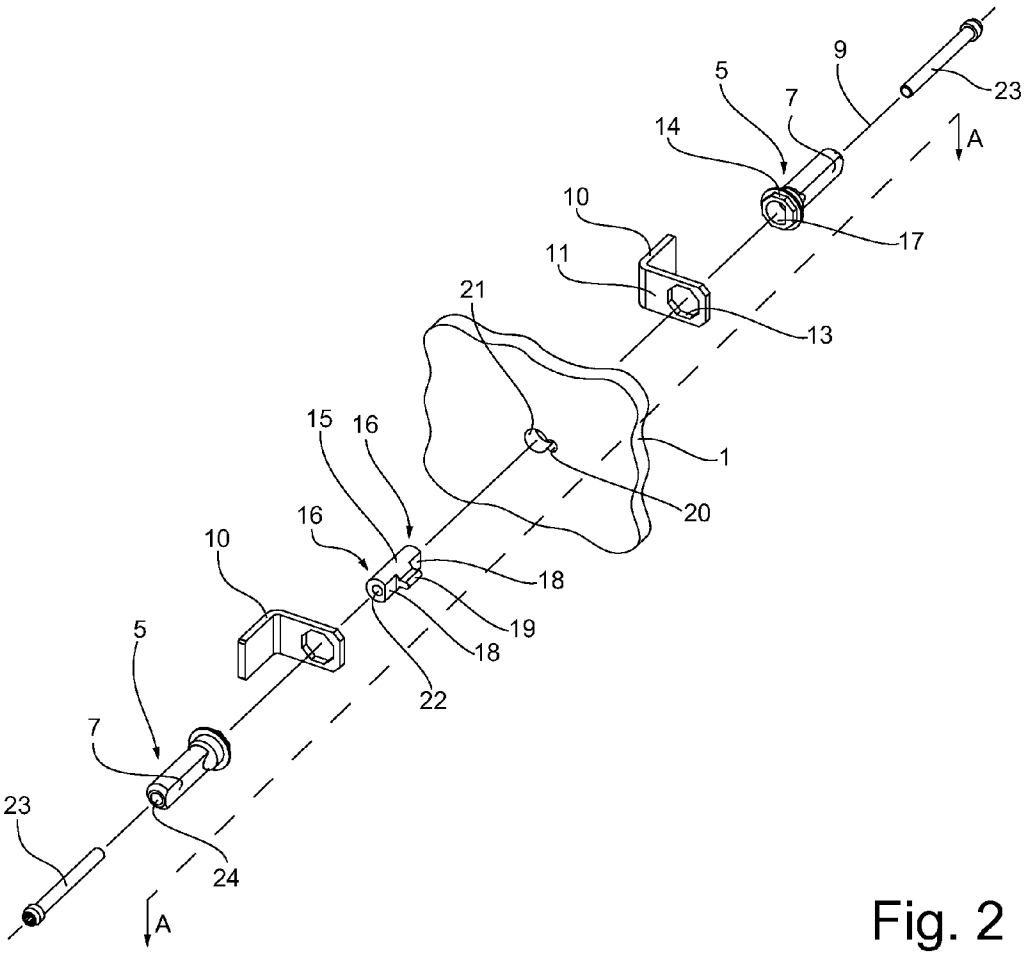
FIG. 2 shows an exploded view of a pair of guide pin elements and an associated connecting member.

According to FIG. 2, the optional spacers 10 have on their second arm 11 a recess in the form of an internal octagon 13. The spacers 10 are plugged positively onto the guide pin elements 5 with their internal octagon 13 onto a receptacle embodied as an external octagon 14 and are thus arranged in a non-rotatable manner relative to the guide pin elements 5.

Arranged between the two guide pin elements 5 is a common connecting member 15 onto which the guide pin elements 5 are plugged. The connecting member 15 is cylindrical and arranged coaxially to the longitudinal axis 9 of the guide pin elements 5. It has two molded sections 16 that point in opposite directions and engage positively in appropriately embodied recesses 17 of the guide pin elements 5. The molded sections 16 each comprise a molded surface 18, which surfaces 18 are arranged parallel to each other according to FIG. 2. As a result of this parallel arrangement of the molded surfaces 18, the guide pin elements 5 are also arranged in identical angular positions about the longitudinal axis 9 relative to the backplane 1. Consequently, the coding surfaces 7 are necessarily oriented parallel to each other.

Alternatively, the molded surfaces 18 can also be arranged such that they are rotated counter relative to each other. In this case, the coding surfaces 7 would also be oriented in different angular positions.

The connecting member 15 also has a lug 19 that engages in a recess 20 of an attachment hole 21 in the backplane 1. On the sides facing toward the guide pin elements 5, the connecting member 15 has threaded holes 22.

In order to attach the guide pin elements 5 to the connecting member 15, threaded rods 23 are provided that are plugged through central through holes 24 into the guide pin elements 5 and screwed into the threaded holes 22 of the connecting member 15. The coaxially arranged guide pin elements 5 with coding surface 7 form, together with the connecting member 15, an arrangement for protecting against incorrect plugging of plug-in modules (not shown).

Figure 3:
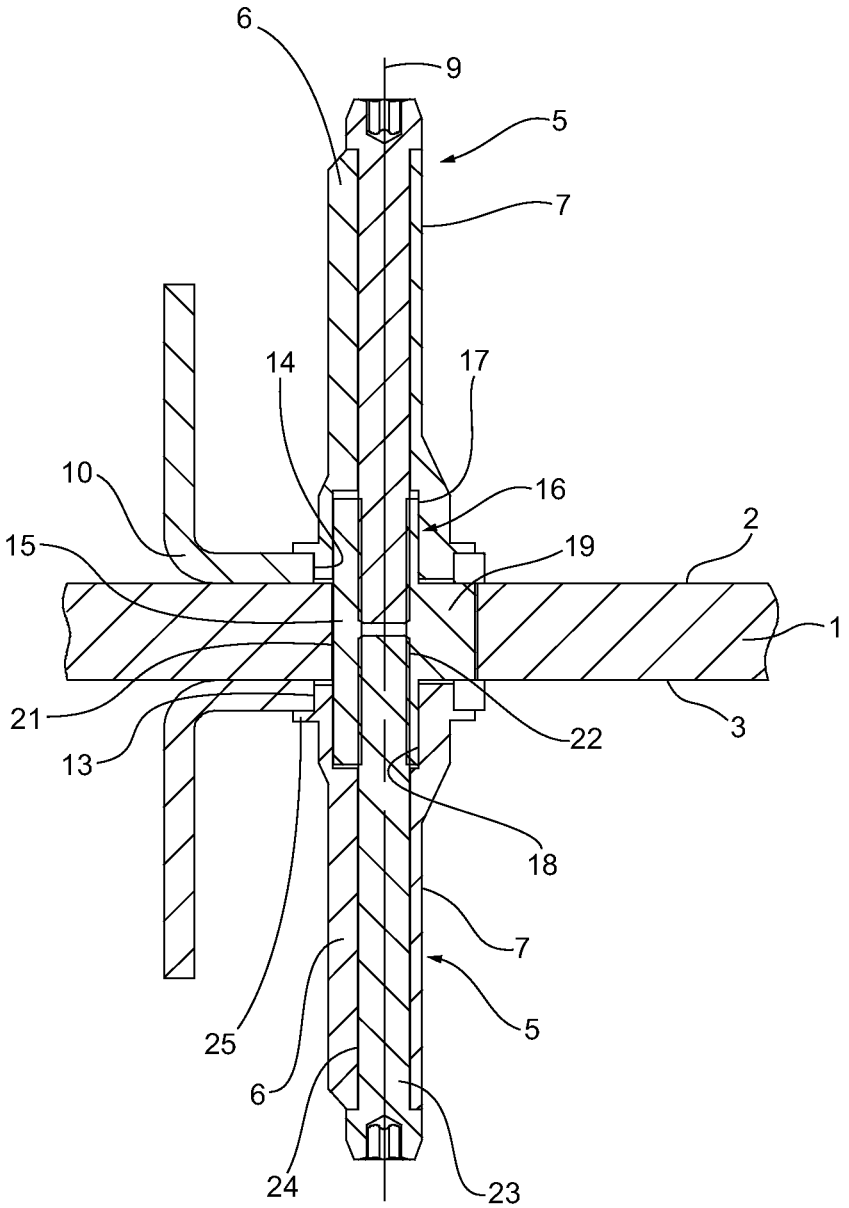
FIG. 3 in a vertical section along the line A-A of FIG. 2, shows a pair of guide pin elements that are mounted on a backplane.

In the following, the mounting of the connecting member 15 and of the guide pin elements on the backplane 1 are explained with reference to FIG. 3.

The connecting member 15 is inserted with its lug 19 into the attachment hole 21 of the backplane 1, so that the lug 19 engages into the recess 20 (FIG. 2) of the attachment hole 21. The connecting member 15 is this connected to the backplane 1 in a non-rotatable manner.

The optional spacers 10 are plugged on with their internal octagon 13 onto the exterior octagon 14 of the guide pin elements 5 and come to rest against projection 25 that bounds the exterior octagon 14 along the longitudinal axis 9.

The guide pin elements 5 are then pushed together with the spacers 10 onto the connecting member 15, so that the spacers 10 come to rest against the front side 2 and the back side 3 of the backplane 1. Here, the molded sections 16 of the connecting member 15 engage positively in the recesses 17 of the guide pin elements 5. Since the recesses 17 are embodied so as to correspond to the molded sections 16 with their molded surfaces 18, the guide pin elements 5 can only be plugged in one established position relative to the connecting member 15. The angular positions of the guide pins 6 about the longitudinal axis 9 relative to the backplane 1 are thus established. According to FIG. 3, the guide pin elements 5 are arranged in identical angular positions, in the direction of rotation about the longitudinal axis 9, so that the coding surfaces 7 are aligned parallel to each other.

To attach the guide pin elements 5 to the backplane 1, the threaded rods 23 are inserted through the through holes 24 into the guide pin elements 5 and screwed into the threaded holes 22 of the connecting member 15. Since both guide pin elements 5 are screwed with the aid of the threaded rods 23 on opposite sides with the connecting member 15 and are supported on the backplane 1 via the spacers 10, they are braced against the backplane 1 by tightening the threaded rods 23.

If the guide pin elements 5 are to be mounted without spacers 10, the guide pin elements 5 come to rest with their ends facing toward the backplane 1 directly against the backplane 1.

Figure 4:
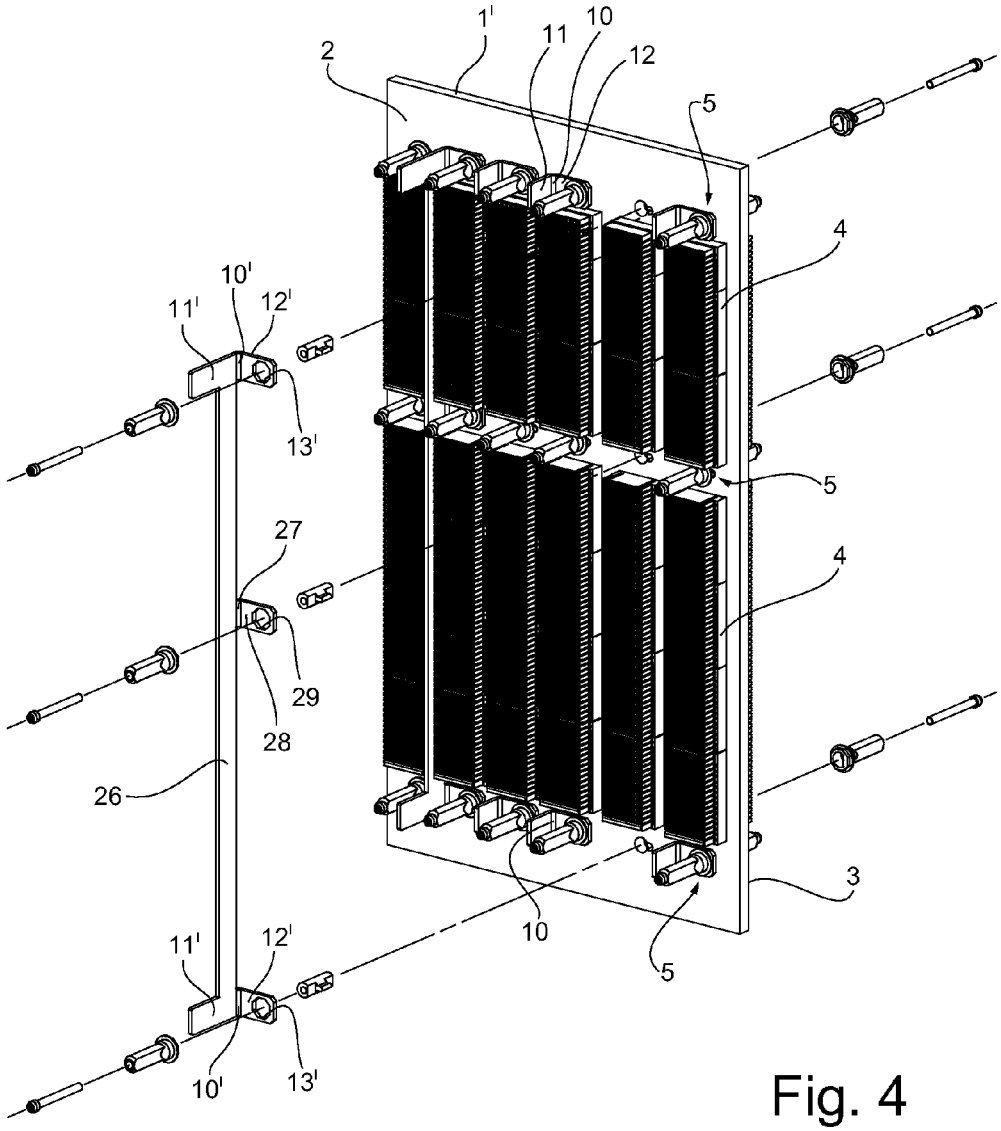
FIG. 4 shows a perspective view of a second backplane with several slots, a corresponding number of guide pins and a reinforcement rail.

FIG. 4 shows a second backplane 1' which differs from the backplane 1 from FIG. 1 by two rows each having six slots 4 arranged one above another.

In the vertical direction along two slots 4 arranged one above another are arranged a total of three guide pin elements 5 each on the front side 2 and the rear side 3 of the backplane 1'. Optionally, a spacer 10 is provided on each of the guide pin elements 5 located above and below the slots 4 arranged one above another.

FIG. 4 shows a reinforcement rail 26 which extends perpendicular to the plane of the backplane 1' and connects two spacers 10' to each other. The guide [sic] rail 26 and the spacers 10' are embodied in a single piece. In the spacers 10, the first arm 11' is longer than the first arm 11 of a spacer 10 in the arrangement of FIG. 1. The first arm 11' corresponds approximately to the entire length of a guide pin element 5, whereas the first arm 11 of a spacer 10 corresponds only to about half of the entire length of a guide pin element 5.

The spacer 10' in FIG. 4 further comprises a second arm 12' with an internal octagon 13', the second arm 12' corresponding to the second arm 12 of the spacer 10 of FIG. 1.

A mounting bracket 27 with an arm 28 than also has a recess embodied as an internal octagon 29 is arranged between the two spacers 10' on the reinforcement rail 26.

The reinforcement rail 26 is attached to the backplane 1' as a result of the guide pin elements 5 each engaging with their external hexagon 14 (FIG. 2) in the internal octagon 13' of the spacers 10' and in the internal octagon 29 of the mounting bracket 27.

While exemplary embodiments have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE SYMBOLS

1, 1' backplane
2 front side
3 rear side
4 slot
5 guide pin element
6 guide pin
7 coding surfaces
8 end (guide pin)
9 longitudinal axis
10, 10' spacer
11, 11' first arm
12, 12' second arm
13, 13' internal hexagon (spacer)
14 external hexagon (guide pin element)
15 connecting member
16 molded section (connecting member)
17 recess (guide pin element)
18 molded surface (molded section)
19 lug (connecting member)
20 recess (attachment hole)
21 attachment hole (backplane)
22 threaded hole
23 threaded rod
24 through hole (guide pin element)
25 projection (guide pin element)
26 reinforcement rail
27 mounting bracket
28 arm (mounting bracket)
29 internal hexagon (arm)

What is claimed is:

1. An arrangement for preventing incorrect plugging of plug-in modules to the front and rear sides of a backplane, the arrangement comprising:

a pair of identical guide pin elements non-rotatably mounted on the front and rear sides of the backplane in a predetermined angular position and extending along a common axis perpendicular to the backplane, the guide pin elements having guide pins pointing in opposite directions, the guide pin elements being adapted to engage corresponding guide recesses of the plug-in modules when the plug-in modules are plugged into the back plane in the correct orientation relative to the guide pins; and a central connecting member arranged between the guide pin elements that is non-rotatably insertable into an attachment hole of the backplane, the connecting member having two molded sections that point in opposite directions and engage in respective recesses of the guide pin elements, thereby establishing the angular positions of the guide pins about the common axis relative to the backplane.

2. The arrangement of claim 1, wherein the connecting member is cylindrical and arranged coaxially to the longitudinal axis of the guide pin elements.

3. The arrangement of claim 2, wherein the connecting member has a radially outwardly pointing lug.

4. The arrangement of claim 1, wherein the guide pin elements have central through holes and the connecting member has threaded holes aligned therewith, the arrangement further comprising threaded rods that engage through the through holes into the threaded holes.

5. The arrangement of claim 1, wherein the guide pins have lateral coding surfaces to establish a predefined orientation of the plug-in modules relative to the guide pins.

6. The arrangement of claim 1, wherein the guide pin elements are arranged in identical angular positions in the direction of rotation about the longitudinal axis so that the coding surfaces are oriented parallel to each other.

7. The arrangement of claim 1, further comprising a spacer with an L-shaped cross section whose first L-shaped arm extends parallel to one of the guide pins and whose second L-shaped arm has a recess in which one of the guide pin elements engage.

8. The arrangement of claim 7, wherein the one guide pin element engages positively in the recess of the associated spacer so that the spacer is non-rotatable relative to the one guide pin element.

9. The arrangement of claim 7, further comprising additional guide pin elements arranged at a distance from each other on the same side of the backplane and associated additional spacers, wherein at least two spacers are connected by a reinforcement rail that extends perpendicular to the plane of the backplane.

10. The arrangement of claim 9, wherein the spacers and/or the reinforcement rail are formed of a single piece of metal.

11. The arrangement of claim 9, further comprising a mounting bracket arranged between two mutually spaced spacers and connecting a guide pin element to the reinforcement rail.

* * * * *